United States Patent [19]

Kikuiri et al.

[11] 4,274,913

[45] Jun. 23, 1981

[54] PROCESS FOR PRODUCING ALKALI PULP

[75] Inventors: Makoto Kikuiri; Yoshimi Nakashio; Yasue Arai; Toshio Hidaka, all of Kure, Japan

[73] Assignee: Toyo Pulp Co., Ltd., Tokyo, Japan

[21] Appl. No.: 41,505

[22] Filed: May 22, 1979

[30] Foreign Application Priority Data

| | | | |
|---|---|---|---|
| May 23, 1978 | [JP] | Japan | 53-60638 |
| Sep. 19, 1978 | [JP] | Japan | 53-114882 |
| Dec. 15, 1978 | [JP] | Japan | 53-156026 |
| Apr. 6, 1979 | [JP] | Japan | 54-41839 |

[51] Int. Cl.[3] ..... D21C 3/26

[52] U.S. Cl. ..... 162/65; 162/19; 162/52; 162/57; 162/59; 162/60; 162/237; 162/243

[58] Field of Search ..... 162/65, 52, 40, 246, 162/19, 57, 59, 60, 243, 237

[56] References Cited

U.S. PATENT DOCUMENTS

| | | | |
|---|---|---|---|
| 3,298,899 | 1/1967 | Laakso | 162/19 |
| 3,303,088 | 2/1967 | Gessner | 162/60 |
| 3,579,421 | 5/1971 | Richter | 162/237 |
| 3,787,284 | 1/1974 | Richter | 162/243 |
| 4,155,806 | 5/1979 | Mannbro | 162/65 |

OTHER PUBLICATIONS

"High Oxidative Pulping Enclosed System Doddel System", Brochure of Toyo Pulp Co., Ltd., CAT No. HP 7804, Apr. 1, 1978.

*Primary Examiner*—William F. Smith

*Attorney, Agent, or Firm*—Wenderoth, Lind & Ponack

[57] ABSTRACT

A process for producing alkali pulp by using a single, cylindrical pressurized reaction vessel having therein a liquor-inpregnating zone, a cooking zone, a washing zone, and a diluting zone in that order, and having a motor-driven scraping or agitating device and a pulp discharging outlet in the end portion of the diluting zone. Alkaline aqueous medium containing dissolved oxygen therein is introduced into the diluting zone. A part of the introduced alkaline aqueous medium countercurrently contacts cooked cellulosic materials transferred from the washing zone to the diluting zone to proceed with oxygen-alkali delignification, and is finally discharged out of the vessel from the end portion of the cooking zone. The remainder of the introduced alkaline aqueous medium contacts the cooked cellulosic materials in the diluting zone in a scraping or agitating manner by means of the motor-driven scraping or agitating device to proceed with oxygen-alkali delignification, and finally serves as diluting liquor to be discharged out of the vessel accompanying the resulting pulp.

11 Claims, 8 Drawing Figures

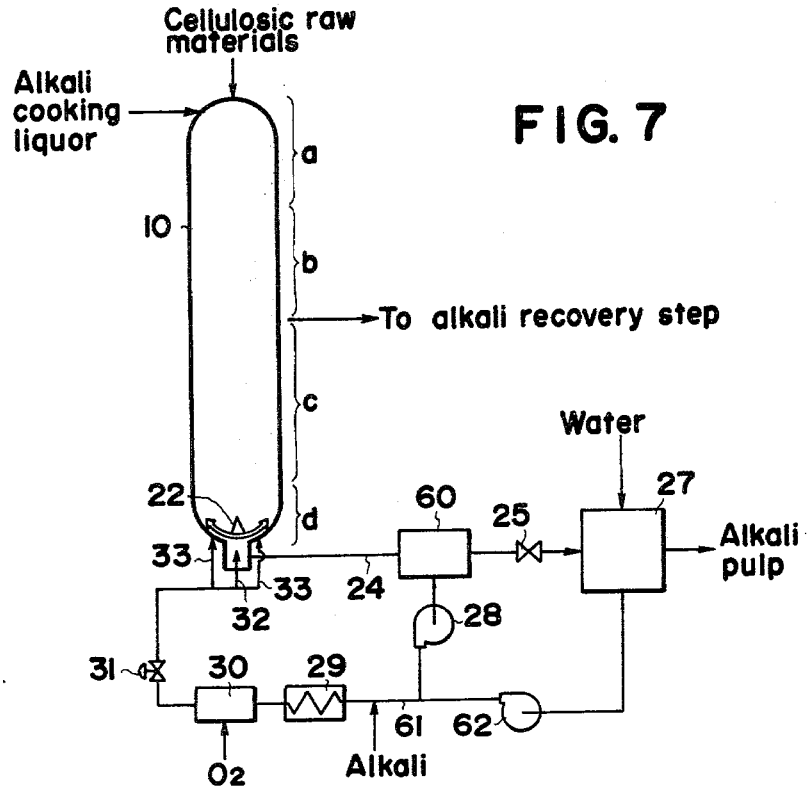
FIG. 7
FIG. 8
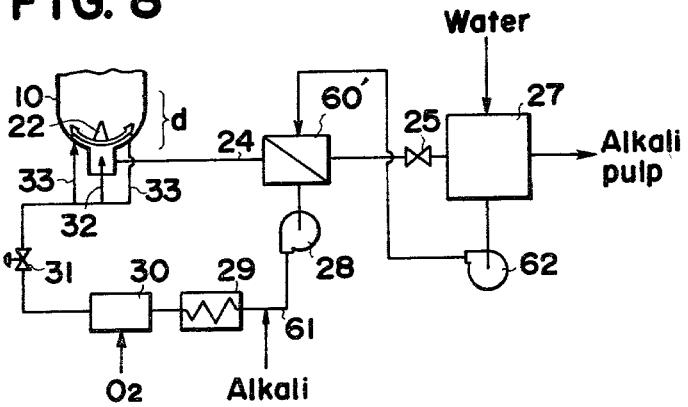

PROCESS FOR PRODUCING ALKALI PULP

BACKGROUND OF THE INVENTION

The present invention relates to a process for producing alkali pulp by cooking chip-form cellulosic raw materials using an alkaline cooking liquor and subsequently oxygen-alkali delignifying the cooked cellulosic materials with an alkaline aqueous medium containing dissolved oxygen therein, in a single pressurized reaction vessel.

There has already been proposed a process for alkali cooking chip-form cellulosic raw materials, washing the cooked cellulosic materials, and subjecting them to liquor-displacement delignification using an alkaline aqueous medium containing dissolved oxygen therein in a single pressurized reaction vessel (see Australian Pat. No. 495,331).

The above-described process employs a single, cylindrical pressurized reaction vessel in which an alkali cooking zone, a washing zone, and a liquor-displacement delignifying zone are provided in that order. Chip-form cellulosic raw materials are introduced into the reaction vessel, and are subjected to alkali cooking and washing, and are transferred within the reaction vessel from the washing zone to the delignifying zone. In the liquor-displacement delignifying zone, the cooked cellulosic materials, still in chip-form, are contacted with an alkaline aqueous medium containing dissolved oxygen to proceed with oxidative delignification. A part of waste liquor, formed during delignification, is continuously discharged from the delignifying zone, while fresh alkaline aqueous medium containing dissolved oxygen is continuously charged into the delignifying zone, whereby the continuous displacement of the waste liquor with the fresh alkaline aqueous medium containing dissolved oxygen is carried out. The thus delignified cellulosic materials are removed from the reaction vessel.

In order to introduce the alkaline aqueous medium containing dissolved oxygen into the delignifying zone in the above-described process, an operation as shown in FIG. 1 has been conducted. Namely, in FIG. 1, the cooked cellulosic materials descend inside the pressurized reaction vessel 1 from the washing zone 2 to the delignifying zone 3. The alkaline aqueous medium containing dissolved oxygen is sprayed through a central feeding pipe 4 onto the descending cellulosic materials. If desired, the alkaline aqueous medium may also be introduced into the delignifying zone from a nozzle 5 provided at the side wall of the vessel 1. The waste liquor formed during delignification is continuously discharged through a strainer 6 provided at the peripheral portion of the vessel. The cooked and oxygen-alkali delignified cellulosic materials then reach a diluting zone 7 where they are diluted with a washing filtrate sent from a washer 8, and are discharged from a discharging outlet 9, and then are sent to the washer 8 where they are washed with water.

The above-mentioned operation for introducing alkaline aqueous medium containing dissolved oxygen, however, is not necessarily satisfactory from the standpoint of uniform contact of cellulosic materials with the alkaline aqueous medium, and homogeneous delignification.

There is another prior art process for producing alkali pulp using a single, cylindrical pressurized reaction vessel in which a liquor-impregnating zone, a cooking zone, a washing zone and a diluting zone are provided in that order. In the end portion of the diluting zone, a motor-driven scraping or agitating device and a pulp discharging outlet are provided. Chip-form cellulosic raw materials are subjected to impregnation of alkali cooking liquor, alkali cooking, washing and diluting, in succession, during their downward movement inside the reaction vessel. Thus cooked cellulosic materials are finally discharged from the discharging outlet (see, for example, U.S. Pat. No. 3,298,899).

However, there is no disclosure of a process for producing alkali pulp by alkali cooking, washing and oxygen-alkali delignifying cellulosic materials successively in such conventional cylindrical single pressurized reaction vessel.

SUMMARY OF THE INVENTION

An object of the present invention, therefore, is to provide a process for effectively producing alkali pulp by subjecting cellulosic materials successively to alkali cooking, washing and oxygen-alkali delignification in a single pressurized reaction vessel.

Another object of the present invention is to provide a process for effectively producing alkali pulp by subjecting cellulosic materials successively to alkali cooking, washing and oxygen-alkali delignification in a single pressurized reaction vessel by conducting homogeneous oxygen-alkali delignification.

A further object of the present invention is to provide a process for producing alkali pulp by subjecting cellulosic materials successively to alkali cooking, washing and oxygen-alkali delignification using a conventional single pressurized reaction vessel in which a liquor-impregnating zone, a cooking zone, a washing zone and a diluting zone having a motor-driven scraping or agitating device and a pulp discharging outlet in the end portion of the diluting zone, are provided in that order.

The present invention is an improvement of a conventional process for producing alkali pulp by using a single, cylindrical pressurized reaction vessel having therein a liquor-impregnating zone, a cooking zone, a washing zone, and a diluting zone in that order, and having a motor-driven scraping or agitating device and a pulp discharging outlet in the end portion of the diluting zone. Such conventional process comprises continuously introducing chip-form cellulosic raw materials into the reaction vessel, subjecting the cellulosic materials to impregnation of alkali cooking liquor, alkali cooking, washing and diluting, in succession, during their downward movement inside the reaction vessel, and continuously discharging the resulting pulp out of the vessel through the discharging outlet.

The improvement according to the present invention comprises continuously introducing alkaline aqueous medium containing dissolved oxygen into the end portion of the diluting zone. A part of the introduced alkaline medium containing dissolved oxygen is brought into countercurrent contact with the cooked cellulosic materials moving downwardly from the washing zone to the diluting zone to proceed with oxygen-alkali delignification. Waste liquor produced during delignification due to the countercurrent contact is transferred to the washing zone where it is used as washing liquor, and is finally discharged out of the vessel from the end portion of the cooking zone to an alkali recovery step. On the other hand, the remainder of the introduced alkaline aqueous medium containing dissolved oxygen is brought into contact with the cooked cellulosic materials in the diluting zone in a scraping or agitating manner by means of the motor-driven scraping or agitating device to proceed with oxygen-alkali delignification, and finally serves as diluting liquor to be discharged out of the vessel, accompanying the resulting pulp, from the pulp discharging outlet.

In an embodiment of the present invention, all of the waste liquor produced during delignification due to the countercurrent contact of a part of the alkaline aqueous medium containing dissolved oxygen with the cooked cellulosic materials moves upwardly to the washing zone, and is finally discharged out of the reaction vessel from the end portion of the cooking zone. Thus, a quantity of the alkaline aqueous medium countercurrently contacted with the cooked materials is equivalent to a liquor quantity corresponding to a dilution factor. Here, the dilution factor is defined as follows:

$$\frac{\text{Quantity of diluting liquor (T/Hr)} - \text{Quantity of liquor carried away with pulp (T/Hr)}}{\text{Air-dried pulp (T/Hr)}}$$

This represents, in other words, a liquor quantity transferred into the washing zone as washing liquor per pulp ADT (ton of air-dried pulp).

In another embodiment of the present invention, a part of the waste liquor produced during delignification due to the countercurrent contact moves upwardly to the washing zone, and is finally discharged out of the vessel from the end portion of the cooking zone. Said liquor quantity is equivalent to the dilution factor. The remainder of the waste liquor is discharged out of the vessel from the end portion of the washing zone. Thus, the total quantity of the alkaline aqueous medium countercurrently contacted with the cooked cellulosic materials is greater than the dilution factor. According to this embodiment, increased amount of the alkaline medium containing dissolved oxygen can countercurrently contact with the cooked cellulosic materials moving downwardly from the washing zone to the diluting zone and, therefore, oxygen-alkali delignification due to the countercurrent contact can be promoted.

These and other objects and advantages of the invention will become apparent as the invention becomes better understood by reference to the following detailed description when considered in conjunction with the accompanying drawings.

BRIEF DESCRIPTION OF THE DRAWINGS

FIGS. 7 and 8 show still further embodiments of the invention in which discharged liquor maintained at a high temperature and pressure is separated from a pulp blow line under the high temperature and pressure condition.

DETAILED DESCRIPTION OF THE INVENTION

Figure 2:
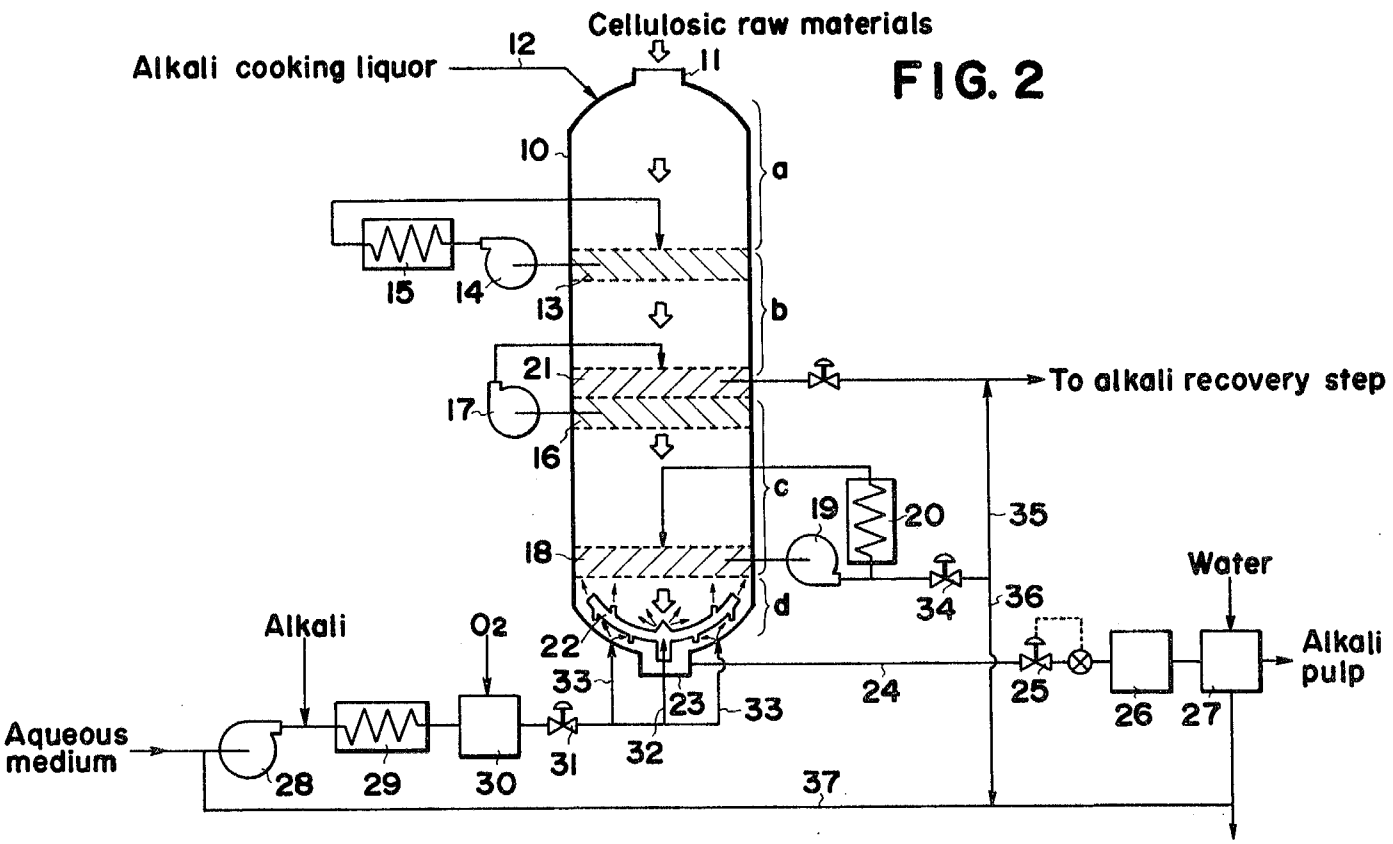
FIG. 2 is a schematic diagram of a flow sheet showing an embodiment of the present invention.

FIG. 2 is a flow sheet showing an embodiment of the invention in which cellulosic materials are fed from an upper portion of a single pressurized reaction vessel and are discharged from a bottom outlet of the reaction vessel. A conventional process for alkali cooking of the cellulosic materials will be explained hereinbelow, referring to FIG. 2. Chip-form cellulosic raw materials are introduced from a feeding inlet 11 located at the top of a single, cylindrical pressurized reaction vessel 10, and alkali cooking liquor is introduced from a conduit 12. In a liquor-impregnating zone a, the cellulosic raw materials are impregnated with the alkali cooking liquor under a high temperature and pressure condition. The cellulosic raw materials descending inside the vessel are heated to a cooking temperature by means of a circulation loop consisting of a strainer 13, a circulating pump 14 and heater 15, and are cooked with the alkali cooking liquor in a cooking zone b. The cellulosic materials are then cooled by means of a circulation loop for quencing which consists of a strainer 16 and a circulating pump 17, to thereby stop the cooking reaction. The thus cooked cellulosic materials are washed in a washing zone c by upwardly flowing a liquid stream from the bottom of the vessel in a countercurrent manner. A part of diluting liquor introduced from the bottom of the reaction vessel 10 is sieved off through a strainer 18, pumped by a pump 19, heated by a heater 20, and is again introduced to a central area at the end portion of the washing zone c as hi-heat washing liquor. The washing liquor flows upwardly to the zone c to countercurrently wash the cooked cellulosic materials, and it is then sieved off through the strainer 16 to be circulated in the quenching circulation, and is finally discharged out of the vessel, together with alkali cooking waste liquor, through a strainer 21 inserted at the end portion of the cooking zone b to be sent to an alkali recovery step. The thus cooked and washed cellulosic materials descend to a diluting zone d where the consistency of the cellulosic materials is reduced with the diluting liquor scraping or agitating a column of cellulosic materials by means of a motor-driven scraping or agitating device 22, and are discharged through a pulp discharging outlet to be blown into a blow tank 26 via a blow line 24 and a blow valve 25, and are finally sent to a washing device 27 where they are washed with water.

The present invention is basically different from such conventional process as described above in that alkaline aqueous medium into which oxygen is previously dissolved outside the reaction vessel, is introduced into the end portion of the diluting zone d, in order to carry out oxygen-alkali delignification in the zone d. Namely, alkaline aqueous medium, pressurized by a high-pressure pump 28, admixed with alkali required for oxygen-alkali delignification, and heated by a heater 29 to a temperature required for oxygen-alkali delignification, i.e. 100° to 150° C., is introduced in an oxygen-dissolving device 30. The alkaline aqueous medium into which oxygen is sufficiently dissolved in the device 30, is introduced as alkaline aqueous medium containing dissolved oxygen into the diluting zone d via a control valve 31. In general, washing filtrate fed from the washer 27 is employed as the alkaline aqueous medium into which oxygen is to be dissolved.

The introduction of the alkaline aqueous medium containing dissolved oxygen into the end portion of the diluting zone d is accomplished by passing it through a central shaft, arm and vanes of the motor-driven scraping or agitating device 22 via a conduit 32 and/or by diffusing it toward the zone c through a wall of the reaction vessel 10 in the zone d via conduits 33.

As the alkaline aqueous medium containing dissolved oxygen is introduced to fill nearly the whole area in the diluting zone d, a part of the alkaline aqueous medium is sieved off through the strainer 18 to be sent to a circulation loop for hi-heat washing consisting of the pump 19 and heater 20, and is returned to the end portion of the washing zone c as washing liquor ascending in the zone c, which is finally discharged through the strainer 21 to be sent to the alkali recovery step. The alkaline aqueous medium thus introduced into the diluting zone d contacts the cooked cellulosic materials descending from the zone c to the zone d in a countercurrent manner to thereby proceed with oxygen-alkali delignification. Since a part of the introduced alkaline aqueous medium containing dissolved oxygen serves as washing liquor after it is used for oxygen-alkali delignification, unreacted oxygen dissolved in the aqueous medium is expected to oxidize dissolved organic substances. This leads to assist the washing of the cooked cellulosic materials.

On the other hand, the remainder of the alkaline aqueous medium introduced in the diluting zone d contacts the cooked cellulosic materials in a scraping or agitating manner by means of the scraping or agitating device 22 through which the alkaline aqueous medium is also fed. Oxygen-alkali delignification occurs by such contact due to scraping or agitating, and the aqueous medium finally serves to dilute the resulting pulp as diluting liquor which is required for discharging the pulp smoothly through the pulp discharging outlet 23.

Figure 3:
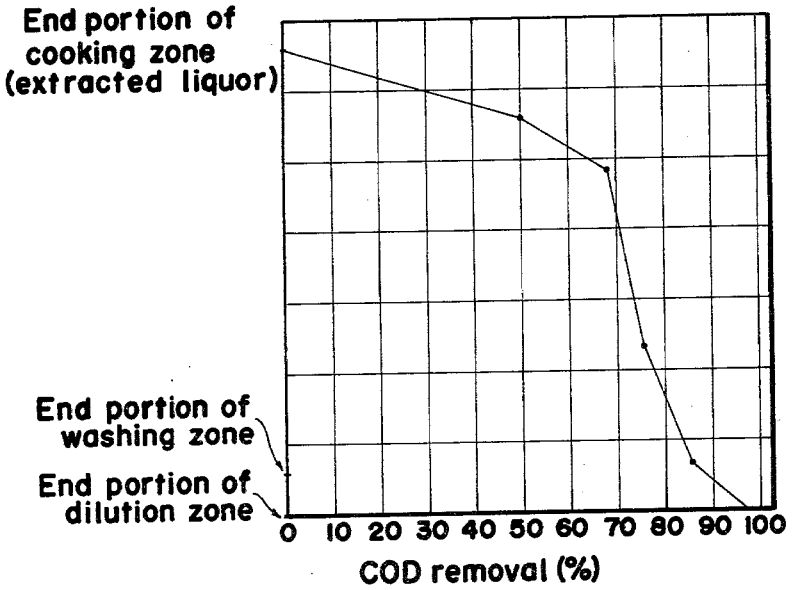
FIG. 3 is a graph showing percentage of COD removal at various phases in a single pressurized reaction vessel of FIG. 2.

The cooked cellulosic materials which reach the end portion of the diluting zone d are in an optimum washed state within the reaction vessel 10, as obvious from FIG. 3. Therefore, by introducing the alkaline aqueous medium containing dissolved oxygen into the end portion of the zone d, the hindrance to delignification caused by dissolved organic substances is reduced to the minimum. In addition, slow and mild scraping or agitation by means of the scraping or agitating device 22 enables the cooked cellulosic materials to be effectively mixed, without mechanical damage, with the alkaline aqueous medium, so that most effective and homogeneous oxygen-alkali delignification is provided.

Figure 1:
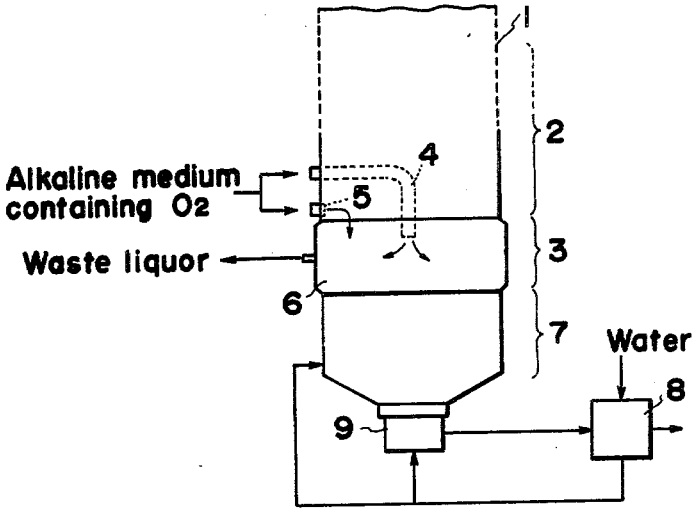
FIG. 1 PRIOR ART
FIG. 1 is a diagram showing a prior art operation for introducing alkaline aqueous medium containing dissolved oxygen into a single pressurized reaction vessel in which cellulosic raw materials are subjected successively to alkali cooking, washing and oxygen-alkali delignification.

The cellulosic materials transferred from the zone c to the zone d have a continuous phase of an agglomerated column of cooked cellulosic materials, yet maintaining the original chip-form. When the resulting pulp is discharged from the vessel through the scraping or agitating device 22 inserted at the end portion of the zone d, the terminal surface of the continuous phase of the agglomerated column of cellulosic materials is always exposed to the alkaline aqueous medium containing dissolved oxygen. Namely, owing to scraping or agitating action of the motor-driven scraping or agitating device 22, the newly revealed terminal surface of the continuous phase of the agglomerated column consisting of the cooked, chip-form cellulosic materials continuously descends to the area of the zone d where the alkaline aqueous medium containing dissolved oxygen is filled, and contacts the dissolved oxygen to proceed with oxidative delignification. As a result of this, the homogeneity of delignification can be greatly improved, which has been difficult to obtain in the prior art operation as shown in FIG. 1.

As hereinbefore described, a part of the alkaline aqueous medium containing dissolved oxygen introduced into the diluting zone d becomes an upwardly flowing liquor stream which countercurrently contacts the cooked cellulosic materials transferred from the zone c to the zone d. The waste liquor formed during delignification due to such countercurrent contact is sieved off through the strainer 18, and is again introduced into the end portion of the washing zone c to serve as washing liquor in the zone c. In this case, when all of the waste liquor withdrawn from the strainer 18 is pumped to the zone c by closing a valve 34 without discharging the waste liquor out of the system, then it is necessary to limit the amount of the alkaline aqueous medium to be countercurrently contacted with the cooked cellulosic materials to an amount of liquor corresponding to the dilution factor employed in the zone c. Such amount of liquor corresponding to the dilution factor is generally about 0.5 to 4 $m^3$ (or ton), preferably 1.5 to 3 $m^3$ (or ton) per pulp ADT. If the amount of liquor flowing upwardly in the washing zone c is greater than about 4 $m^3$/pulp ADT, the downward movement of the cellulosic materials in the zone c tends to be disturbed. If such amount of the liquor in the zone c is smaller than about 0.5 $m^3$/pulp ADT, the washing is not sufficiently effected in the zone c.

In the case where all of the waste liquor formed during delignification due to the countercurrent contact is transferred to the washing zone c (valve 34 is closed), the amount of liquor transferred to the zone c is limited, as described above. Accordingly, if the amount of the alkaline aqueous medium introduced in the end portion of the diluting zone d is increased, the amount of liquor to be discharged with pulp from the discharging outlet 23 is necessarily required to be increased, causing the blow consistency to be decreased. However, too low blow consistency is not desirable, so that the amount of the alkaline aqueous medium containing dissolved oxygen to be introduced into the zone d is restricted by the allowable blow consistency. According to experiments conducted by the present inventors, for example, a pulp consistency of about 4 to 10% by weight is preferred for smoothly and stably blowing pulp from the reaction vessel after oxygen-alkali delignification of the cooked cellulosic materials descending from the zone c to the zone d which have a pulp consistency of about 12% by weight, using the process of the above-mentioned embodiment of the invention. In order to obtain such blow consistency of about 4 to 10% by weight, it is preferred to restrict the amount of the alkaline aqueous medium to be introduced into the zone d within the range of about 28 to 13 times the weight of air-dried cooked cellulosic materials.

However, since oxygen dissolved in the alkaline aqueous medium functions as a delignifying agent in an alkaline medium, the degree of delignification in the zone d depends upon the absolute amount of dissolved oxygen. In this case, if conditions for dissolving oxygen into the aqueous medium are constant, it is necessary to increase the amount of the alkaline aqueous medium containing dissolved oxygen to be introduced, with respect to the weight of the cooked cellulosic materials, in order to increse the degree of delignification.

Therefore, according to another embodiment of the present invention, a part of liquor sieved off through the strainer 18 of FIG. 2 is discharged out of the system through the valve 34, in order to increase the amount of the alkaline aqueous medium introduced into the zone d. Namely, it is possible to introduce the increased amount of the alkaline aqueous medium containing dissolved oxygen into the zone d by withdrawing an equivalent amount of the system through the valve 34. In this case, only a part of the liquor, which is equivalent to the amount corresponding to the dilution factor, is returned to the end portion of the washing zone c to serve as washing liquor, and is finally discharged from the strainer 21, and the remaining part of the liquor sieved off through the strainer 18 is discharged through the valve 34. The thus discharged liquor may be sent to the alkali recovery step via a line 35, or may be recycled to the oxygen dissolving step via lines 36 and 37.

In the above-mentioned embodiment in which a part of the liquor is discharged through the valve 34, the amount of the alkaline aqueous medium containing dissolved oxygen to be introduced into the diluting zone d can be increased to be greater than 30 times the weight of air-dried cooked cellulosic materials and, hence, the increased amount of the alkaline aqueous medium can countercurrently contact the cooked cellulosic materials to thereby promote oxygen-alkali delignification. Also in this case, such amount of the increased liquor countercurrently contacted with the cooked cellulosic materials should be restricted within a range which does not prevent the cellulosic materials from moving downwardly in the zone d. However, the influence of the upwardly flowing liquor on the downward movement of the cooked cellulosic materials in the dilution zone d is not so great as that in the washing zone c, because the continuous phase of the agglomerated cellulosic materials is destroyed in the zone d by means of the scraping or agitating device 22 to form a suspension of the cellulosic materials, and the period of the countercurrent contact is shorter than that in the zone c. Even in this case, by discharging a part of the liquor from the valve 34, it is possible to restrict the amount of upwardly flowing liquor stream from the zone d to the zone c within the amount corresponding to the dilution factor, and to prevent the flow consistency from being lowered excessively.

Figure 4:
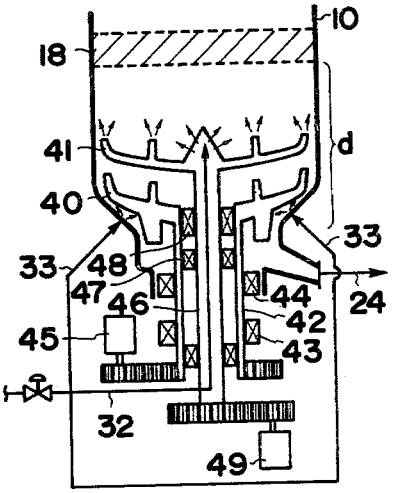
FIG. 4 is a diagram showing another embodiment of the invention in which a plurality of scraping or agitating devices are provided in a diluting zone.

FIG. 4 shows an apparatus for effectively conducting the present invention. This apparatus has, in addition to scraping or agitating vanes 40 for pulp discharge at the end portion of the diluting zone d, separate scraping or agitating vanes 41 in the zone d, and they are driven independently. That is, a shaft 42 of the vanes 40 is supported by a bearing 43 and a bearing 44 which also works as a pressure seal, and is rotated by a motor 45. A shaft 46 of the scraping or agitating vanes 41, on the other hand, is supported by a bearing 47 and a bearing 48 which also works as a pressure seal, and is rotated by a motor 49 independently of the vanes 40. The alkaline aqueous medium containing dissolved oxygen is introduced into the zone d through a line 33 and a line 32 running through the shaft 46. By means of the independently rotating scraping or agitating vanes 41, oxygen-alkali delignification can be accomplished more homogeneously and effectively due to the contact of the alkaline aqueous medium with the cellulosic materials in the zone d in a scraping or agitating manner. In addition, the improved washing can be expected in the diluting zone d by the scraping or agitating vanes 41. Furthermore, the pulp consistency in the zone d can be equalized, to stabilize the subsequent blow of pulp and, hence, the operation can be performed continuously and stably.

Oxygen alkali delignification in the diluting zone d is usually carried out at a temperature of 100° to 150° C. Therefore, the blow line 24 in the downstream of the pulp discharging outlet 23 and leading to the blow valve 25 in FIG. 2 is also maintained at this temperature. Blowing operation under such high temperature is usually called "hot blow", and this causes the degradation of pulp quality and heat loss because a vast amount of flashed steam is generated in the blow tank 26. It is therefore desirable to lower the liquor temperature in the blow line below the boiling point under atmospheric pressure to establish a so-called "cold blow".

Figure 6:
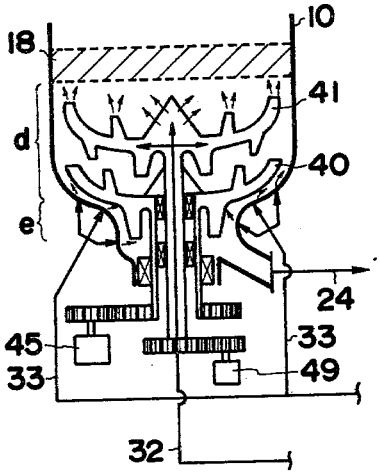
FIGS. 5 and 6 show other embodiments of the invention in which cooling liquor is introduced into the diluting zone.
Figure 5:
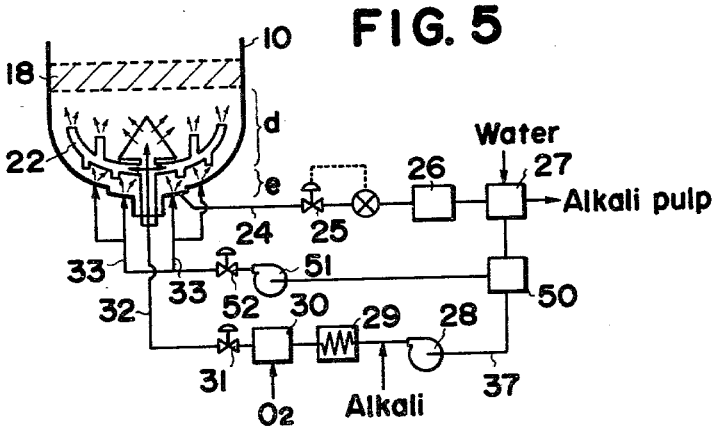

FIGS. 5 and 6 show desirable embodiments of the present invention for performing the cold blow operation. The constructions after the diluting zone d in these FIGS. 5 and 6 are substantially the same as those of FIGS. 2 and 4, so that the same members are denoted by the same reference numerals as those of FIGS. 2 and 4 to avoid repeated description.

Referring to FIG. 5, the alkaline aqueous medium containing dissolved oxygen is introduced from the line 32 into the zone d through the central shaft, arm and vanes of the scraping or agitating device 22, and is diffused toward the washing zone c, which is the same as in FIG. 2. This embodiment, however, is different from that of FIG. 2 in that the filtrate having a low temperature from the washer 27 is conveyed through the line 33, and is uniformly diffused as cooling liquor through the bottom wall of the reaction vessel 10. Namely, the filtrate from the washer 27 is once introduced into a filtrate tank 50 and is separated into two systems. In one system, the filtrate is conveyed through a pump 51 and a control valve 52, and is guided through the line 33 into the reaction vessel as the cooling and diluting liquor. In another system, the filtrate is sent through the line 37 to the oxygen dissolving step, and is introduced through the line 32 into the vessel as the alkaline aqueous medium containing dissolved oxygen.

The cooling and diluting liquor has a function to lower the temperature of oxygen-alkali delignification in the end portion of the diluting zone d below the boiling point to perform the cold blow. Thus, it is considered that a cooling zone e is separately disposed adjacent to the zone d. The cooling liquor should have such a temperature that the temperature of the liquor blown out of the reaction vessel is cooled below the boiling point of the liquor. Usually, the temperature of the liquor blown out of the vessel is below 90° C., preferably below 70° C. The cooling liquor need not necessarily be limited to the filtrate from the washer 27, but may be water or other liquors having a low temperature.

FIG. 6 shows another embodiment in which two units of scraping or agitating devices the same as those of FIG. 4 are disposed to more effectively separate the functions of the diluting zone d and the cooling zone e. In the embodiment of FIG. 6, the alkaline aqueous medium containing dissolved oxygen is introduced from the line 32 and is diffused toward the washing zone c through the central shaft, arm and vanes of the scraping or agitating device 41 in the zone d, in the same manner as in FIG. 4. This embodiment, however, is different from that of FIG. 4 in that the cooling and diluting liquor is introduced from the line 33 and is uniformly diffused into the cooling zone e through the wall of the reaction vessel.

According to the embodiment shown in FIG. 2, the resulting pulp is blown together with the liquor from the blow line 24 under the high temperature and pressure into the blow tank 26, under atmospheric pressure, and is washed in the washer 27. The filtrate is pumped into the oxygen dissolving step via the line 37 and is resused. In this case, however, in order to transfer the filtrate, which is under atmospheric pressure, to the oxygen dissolving step to reuse it again as the alkaline aqueous medium containing dissolved oxygen, it is required to pressurize the filtrate up to a desired level by using a liquor transferring pump 28 and to heat the filtrate having a temperature below the boiling pump up to a desired temperature by using a heater 29 disposed in the oxygen dissolving step. The desired pressure generally ranges from 5 to 25 $Kg/cm^2G$, and the desired temperature generally ranges from 100° C. to 150° C. The above-mentioned method for cycling and reusing the discharged liquor requires considerable amount of steam for heating and power for transferring the liquor. Particularly, in the case where a large amount of the alkaline aqueous medium containing dissolved oxygen is introduced into the diluting zone and, hence, a large amount of the discharged liquor is recycled to reuse, it is necessary to use increased amount of power for transferring the liquor, as well as increased amount of steam for heating.

FIGS. 7 and 8 show further embodiments according to the present invention which are designed for minimizing the amount of heating steam and power for transferring the liquor required for circulating and reusing the discharged liquor. In these embodiments, the discharging liquor under the high temperature and pressure is separated from the blow line 24 in FIG. 2 under the high temperature and pressure, and the thus separated liquor is then sent to the oxygen dissolving step under the high temperature and pressure, thereby reducing the amount of steam and power for transferring the liquor required for the oxygen dissolving step.

In the embodiment of FIG. 7, a liquor separating equipment 60 for recovering the discharging liquor under the high temperature and pressure is placed in the blow line 24 and operated under the high temperature and pressure condition. The liquor separated by the liquor separating equipment 60 under the high temperature and pressure is fed by the pump 28 to the oxygen dissolving line 61, and is finally converted into the alkaline aqueous medium containing dissolved oxygen via the heater 29 and the oxygen dissolving device 30, to be fed into the diluting zone d of the reaction vessel 10. Since a part of the alkaline aqueous medium introduced into the zone d, i.e. an amount of the aqueous medium corresponding to the dilution factor, is to be transferred to the washing zone c and used as washing liquor, the amount of the filtrate from the washer 27 to be introduced by a high-pressure pump 62 into the oxygen dissolving line 61 is an amount corresponding to the dilution factor. Thus, there is established a closed circulation loop having high temperature and high pressure consisting of the liquor separating equipment 60, the pump 28, the heater 29 and the oxygen dissolving device 30, whereby the liquor separated by the liquor separating equipment 60 is transferred to the oxygen dissolving line 61 under the high temperature and pressure condition. Therefore, the pump 28 for transferring the liquor need not be a high-pressure pump and, hence, the power required for transferring the liquor can be reduced. Furthermore, an amount of steam to be employed in the heater 29 can be significantly reduced.

The liquor separating equipment 60 employed in the embodiment of FIG. 7 has a function to remove the liquor from the pulp blow line 24, so that the pulp consistency will be increased after separating the liquor from the blow line 24. The liquor, however, may be separated from the pulp blow line also by way of liquor displacement. FIG. 8 shows an embodiment in which the discharging liquor is separated in a manner of liquor displacement. In this case, a liquor displacing equipment 60' is disposed in place of the liquor separating equipment 60 employed in the embodiment of FIG. 7, and the filtrate from the washer 27, in which the washing of pulp is carried out under the atmospheric pressure, is used as a liquor to displace the discharging liquor within the liquor displacing equipment 60'. Namely, the filtrate from the washer 27 is pressurized by the high-pressure pump 62 and is introduced into the liquor displacing equipment 60'. In this equipment 60', the liquor transferred through the pulp blow line 24 under the high temperature and pressure condition is displaced with the filtrate transferred from the washer 27 under the pressure. The liquor thus displaced is transferred to the oxygen dissolving line 61 via the pump 28, and the filtrate, on the other hand, is introduced again into the washer 27 together with pulp. In this case, the amount of liquor corresponding to the dilution factor used as washing liquor in the washing zone c of the reaction vessel 10 is replenished by the filtrate in the liquor displacing equipment 60', and is transferred to the pump 28 together with the displaced and separated liquor. By separating the liquor from the pulp blow line 24 in a manner of liquid displacement, more efficient heat recovery is provided. In addition, even if the temperature of the liquor in the pulp blow line is high, such high-temperature liquor is displaced with the filtrate having a relatively low temperature, so that it is possible to prevent the liquor from boiling in the washing step which is carried out under the atmospheric pressure.

The following examples are given by way of illustration only, and the scope of this invention is not limited by these examples.

EXAMPLE 1

The process of the present invention was carried out by using a single, vertical pressurized reaction vessel of a cylindrical shape as shown in FIG. 2, with a pulp production rate of 35 ADT/D.

Conditions employed in each zone are as follows:

Alkali cooking in the liquor-impregnating zone and cooking zone

Chip-form cellulosic raw materials: Mixed coniferous wood chips (Douglas fir 50 wt%, Radiata pine 20 wt%, Western hemlock 30 wt%);

Alkali used: NaOH;

Alkali charge: 22% as $Na_2O$ based on the weight of dried wood chips;

Amount of anthraquinone (as a cooking additive): 0.1% based on the weight of dried wood chips;

Liquor impregnating time: 60 minutes;

Wood to liquor ratio: 1:3.3;

Maximum cooking temperature: 175° C.;

Cooking time: 60 minutes.

Washing in the washing zone

Washing time: 3 hours;
Dilution factor: 4.

Oxygen-alkali delignification in the dilution zone

Oxygen dissolving temperature: 130° C.;
Oxygen dissolving pressure: 12 Kg/cm$^2$G (total pressure);
Amount of dissolved oxygen: 250 ppm;
Amount of make-up NaOH: 1 g/l as $Na_2O$;
Blow consistency: 6 to 7%.

Alkali pulp which resulted by alkali cooking without oxygen-alkali delignification had an average Kappa No. of 31.7.

The thus resulted alkali pulp was successively subjected to delignification in the single pressurized reaction vessel by using the following two operations:

(A) Alkaline aqueous medium containing dissolved oxygen prepared under the above-indicated conditions was fed and diffused into the end portion of the diluting zone d through the conduits 32, 33 in FIG. 2. The feeding rate of the alkaline aqueous medium was 26.6 m$^3$/Hr. All waste liquor discharged through the strainer 18 was transferred to the washing zone c, without sieving off from the valve 34.

(B) For the purpose of comparison, a single pressurized reaction vessel as shown in FIG. 1 was employed. The same alkaline aqueous medium containing dissolved oxygen as in (A) was fed into the delignifying zone 3 through the central feeding pipe 4 and the nozzle 5, in an amount substantially the same as that employed in (A). The same amount of waste liquor formed during delignification as that of introduced alkaline aqueous medium was discharged from the strainer 6 to thereby carry out displacement delignification.

These two operations (A), (B) were separately carried out for a long period of time in a continuous manner. As a result, pulp having an average Kappa No. of 16.8 was obtained by the operation (A) and, on the contrary, an average Kappa No. of 25.8 by the operation (B).

From the above results, it will be understood that when the alkaline aqueous medium containing dissolved oxygen is introduced in the same amount, the process according to the invention enables oxygen-alkali delignification to be carried out more effectively than the prior art process as shown in FIG. 1.

EXAMPLE 2

The process of the present invention was carried out in the same manner and under the same conditions as in the operation (A) of Example 1, except for employing the feeding rate of the alkaline aqueous medium containing dissolved oxygen into the diluting zone d of 36 m$^3$/Hr, instead of 26.6 m$^3$/Hr, and removing waste liquor from the valve 34 at the rate of 9.4 m$^3$/Hr, to thereby obtain pulp having an average Kappa No. of 14.5.

EXAMPLE 3

The process of the present invention was carried out in the same manner and under the same conditions as in the operation (A) of Example 1, except for employing the following:

Alkali cooking

Maximum cooking temperature: 173° C.

Oxygen-alkali delignification

Oxygen dissolving pressure: 14 Kg/cm$^2$G (total pressure).

Alkali pulp which resulted by alkali cooking without oxygen-alkali delignification had an average Kappa No. of 33.2. The thus resulted alkali pulp was successively subjected to oxygen-alkali delignification and was blown out by way of hot blow to obtain pulp having an average Kappa No. of 18.2.

On the other hand, cold blow of pulp was carried out by using an operation as shown in FIG. 5. Namely, alkaline aqueous medium containing dissolved oxygen was introduced into the diluting zone d through the line 32 at the feeding rate of 26.6 m$^3$/Hr. Cooling liquor was introduced into the cooling zone e through the line 33 at the feeding rate of 9 m$^3$/Hr. Waste liquor was discharged from the strainer 18 at the rate of 9 m$^3$/Hr. to thereby perform cold blow at a blow temperature of 96° C. The thus resulted pulp had an average Kappa No. of 18.0.

The pulp obtained by hot blow and the pulp obtained by cold blow were separately heated by a Valley beater to compare paper strengths at a freeness of 400 ml (C.S.F.). The results obtained are given in Table 1.

TABLE 1

| | Kappa No. | Burst factor | Breaking length, Km | Tear factor |
|---|---|---|---|---|
| Pulp obtained by hot blow | 18.2 | 5.99 | 7.31 | 129 |
| Pulp obtained by cold blow | 18.0 | 6.15 | 7.60 | 145 |

From Table 1, it will be understood that oxygen-alkali delignification is effectively carried out even in the case of cold blow by introducing the cooling liquor in the cooling zone e as shown in FIG. 5.

EXAMPLE 4

The process of the present invention was carried out in the same manner and under the same conditions as in the operation (A) of Example 1, except for employing the following:

Washing

Dilution factor: 2.5.

Oxygen-Alkali delignification

Oxygen dissolving pressure: 15 Kg/cm$^2$G;
Feeding rate of alkaline aqueous medium containing dissolved oxygen: 25.7 m$^3$/Hr. (16.6 m$^3$/pulp ADT).

Blow

Blow line pressure: 12 Kg/cm$^2$G;
Blow line temperature: 130° C.;
Pulp consistency: 6%;
Blow flow: 20.6 m$^3$/Hr (14.1 m$^3$/pulp ADT);
Pulp consistency after the liquor displacing equipment: 10%;
Liquor temperature after the liquor displacing equipment: 85° C.;
Liquor amount used at the liquor displacing equipment: 10.5 m$^3$/pulp ADT;
Temperature of liquor displaced and separated: 80° C.

In this Example, liquor discharged into the blow line 24 of FIG. 8 was recovered under a high temperature and pressure using a liquor displacing equipment 60', by which a closed circulation loop for recovering discharging liquor under a high temperature and pressure was established.

As a comparative experiment, pulp blow was carried out by a conventional open system in which the liquor displacing equipment 60' is not provided in the blow line 24.

The comparative data with respect to energy consumption are given in Table 2.

TABLE 2

| | High temperature and pressurized closed system | Open system |
|---|---|---|
| Amount of steam used (T/pulp ADT) | 0.383 | 1.55 |
| Power required for transferring liquor (KWh/pulp ADT) | 6.08 | 6.87 |
| Kappa No. before oxygen-delignification | 32.0 | 32.4 |
| Kappa No. after oxygen-delignification | 20.5 | 19.8 |

It will be understood from Table 2 that the high temperature and pressurized closed circulation system for recovering discharged liquor from the blow line enables the amount of energy consumption, especially the amount of steam to be greatly reduced without affecting oxygen-alkali delignification.

Although the present invention has been explained in the foregoing by exemplifying the use of a single, vertical-type pressurized reaction vessel in which cellulosic raw materials are charged from the top of the vessel and are discharged from the bottom thereof, it should be noted that the present invention may use a reaction vessel of up-flow-type in which cellulosic raw materials are charged from the bottom of the vessel and are discharged from the top thereof, or a reaction vessel of inclined-type.

What is claimed is:

1. In a process for producing alkali pulp by using a single, cylindrical pressurized reaction vessel having therein a liquor-impregnating zone, a cooking zone, a washing zone and a diluting zone in that order, and having a motor-driven scraping or agitating device and a pulp discharging outlet in the end portion of the diluting zone, which process comprises continuously introducing chip-form cellulosic raw materials into the reaction vessel, subjecting the cellulosic materials to impregnation of alkali cooling liquor, alkali cooking, washing and diluting, in succession, during their transfer inside the reaction vessel, and continuously discharging resulting pulp out of the vessel through the pulp discharging outlet, the improvement comprising:

continuously introducing alkaline aqueous medium containing dissolved oxgygen into the end portion of the diluting zone;

contacting a part of the introduced alkaline aqueous medium containing dissolved oxygen in a countercurrent manner with cooked cellulosic materials transferred from the washing zone to the diluting zone to proceed with oxygen-alkali delignification in the diluting zone, waste liquor produced during delignification due to the countercurrent contact being transferred to the washing zone where it is used as washing liquor and being finally discharged out of the vessel from the end portion of the cooking zone; and contacting the remainder of the introduced alkaline aqueous medium containing dissolved oxygen with the cooked cellulosic materials in the diluting zone in a scraping or agitating manner by means of the motor-driven scraping or agitating device to proceed with oxygen-alkali delignification, said remainder of the alkaline aqueous medium being finally used as diluting liquor to be discharged out of the vessel accompanying the resulting pulp from the pulp discharging outlet.

2. The process according to claim 1, wherein the alkaline aqueous medium containing dissolved oxygen is introduced into the diluting zone on the washing zone side of said scraping or agitating device, and a cooling liquor is introduced into the diluting zone on the pulp discharging outlet side of said scraping or agitating device, thereby discharging the resulting pulp from the pulp discharging outlet at a lowered temperature.

3. The process according to claim 1, wherein a liquor under a high temperature and pressure being discharged with the resulting pulp from the pulp discharging outlet, is separated from a blow line in the downstream of the pulp discharging outlet under a high temperature and pressure, and oxygen is dissolved into the thus separated liquor without relieving the high temperature and pressure to reuse it as the alkaline aqueous medium containing dissolved oxygen.

4. The process according to claim 3, wherein the liquor is separated by removing the liquor from said blow line.

5. The process according to claim 1, wherein all of the waste liquor produced during delignification due to the countercurrent contact of the alkaline aqueous medium containing dissolved oxygen with the cooked cellulosic materials is transferred to the washing zone and is finally discharged out of the reaction vessel from the end portion of the cooking zone, and the amount of the alkaline aqueous medium countercurrently contacted with the cooked cellulosic materials in the diluting zone is equivalent to the amount of liquor corresponding to a dilution factor defined as $$\frac{\text{Quantity of diluting liquor (T/Hr)} - \text{Quantity of liquor carried away with pulp (T/Hr)}}{\text{Air-dried pulp (T/Hr)}}$$

6. The process according to claim 5, wherein the dilution factor is from about 0.5 to 4 $m^3$/pulp ADT.

7. The process according to claim 1, wherein a part of the waste liquor produced during delignification due to the countercurrent contact of the alkaline aqueous medium containing dissolved oxygen is transferred to the washing zone and is finally discharged out of the reaction vessel from the end portion of the cooking zone, said part of the waste liquor being equivalent to an amount of liquor corresponding to a dilution factor, and the remainder of the waste liquor is discharged out of the vessel from the end portion of the washing zone, and the amount of the alkaline aqueous medium countercurrently contacted with the cooked cellulosic materials in the diluting zone is greater than the amount of liquor corresponding to the dilution factor.

8. The process according to claim 1, wherein the alkaline aqueous medium containing dissolved oxygen is introduced by (1) passing it through a central shaft, arm and vanes of said scraping or agitating device disposed in the diluting zone, (2) diffusing it toward the washing zone through a wall of the reaction vessel in the diluting zone, or (3) a combination of (1) and (2).

9. The process according to claim 1, wherein the vessel has two separate independently driven scraping or agitating devices, one of said devices being disposed in the diluting zone on the washing zone side, and the other of said devices being disposed in the diluting zone on the pulp discharging outlet side, thereby promoting the contact of the alkaline aqueous medium with the cooked cellulosic materials in a scraping or agitating manner.

10. The process according to claim 9, wherein the alkaline aqueous medium containing dissolved oxygen is introduced by passing it through said scraping or agitating device disposed in the diluting zone on the washing zone side, and a cooling liquor is introduced into the diluting zone through the wall of the vessel below said scraping or agitating device disposed in the diluting zone on the pulp discharging outlet side, thereby discharging the resulting pulp from the pulp discharging outlet at a lowered temperature.

11. The process according to claim 3, wherein the liquor is separated under pressure by forcing the liquor out of the blow line with a different liquor having a lower temperature than the liquor to be separated.

* * * * *